US010668498B1

(12) United States Patent
Hung

(10) Patent No.: US 10,668,498 B1
(45) Date of Patent: Jun. 2, 2020

(54) CAULKING GUN AND METHOD FOR USING THE SAME

(71) Applicant: SIANG SYUAN FU ENTERPRISE CO., LTD., Changhua County (TW)

(72) Inventor: Hung-Chih Hung, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 16/383,897

(22) Filed: Apr. 15, 2019

(51) Int. Cl.
*B05C 17/01* (2006.01)
*B05C 17/005* (2006.01)

(52) U.S. Cl.
CPC .... *B05C 17/0123* (2013.01); *B05C 17/00596* (2013.01)

(58) Field of Classification Search
CPC ..... B05C 17/0123; B05C 17/00596
USPC ..... 222/391
See application file for complete search history.

(56) References Cited

U.S. PATENT DOCUMENTS

2009/0134187 A1* 5/2009 Hefele ..... B05C 17/0126 222/391

* cited by examiner

*Primary Examiner* — Donnell A Long
(74) *Attorney, Agent, or Firm* — Muncy, Geissler, Olds & Lowe, P.C.

(57) ABSTRACT

A caulking gun is provided, including: a gun body, a push rod, a driving member, a lever and a rotation connecting mechanism. The push rod is movably disposed on the gun body. The driving member is movably disposed within the gun body and frictionally drives the push rod. The lever is swingably disposed on the gun body and includes an abutting portion which is abuttable against the driving member. The rotation connecting mechanism connects the lever and the gun body and includes an axis with a position thereof being changeable. The lever is rotatable about the axis as a rotation center. A method for using the caulking gun as described above is further provided, including following steps of: installing a caulk cartridge to the gun body; adjusting the position of the axis of the rotation connecting mechanism; pressing the lever.

8 Claims, 7 Drawing Sheets

CAULKING GUN AND METHOD FOR USING THE SAME

BACKGROUND OF THE INVENTION

Field of the Invention

The present invention relates to a caulking gun and a method for using the same.

Description of the Prior Art

A caulking gun is configured to caulk gaps at a corner or between gapped objects. A conventional caulking gun includes a gun body, a push rod movably disposed on the gun body, a driving member frictionally driving the push rod, and a lever which is abuttable against the driving member. For various requirements, the convention caulking gun controls a squeezing amount of the caulking material by restricting a swinging range of the lever or pushing the driving member in different position. However, an adjusting mechanism of the conventional caulking gun for controlling the squeezing amount of the caulking material has a complicated structure and is inconvenient to be manufactured and adjusted, and the adjusting mechanism cannot accurately control the squeezing amount of caulking material.

The present invention is, therefore, arisen to obviate or at least mitigate the above-mentioned disadvantages.

SUMMARY OF THE INVENTION

The main object of the present invention is to provide a caulking gun and a method for using the same, and a rotation center of a lever of the caulking gun is changeable.

To achieve the above and other objects, the present invention provides a caulking gun, including: a gun body; a push rod, being movably disposed on the gun body; a driving member, being movably disposed within the gun body and frictionally driving the push rod; a lever, being swingably disposed on the gun body, including an abutting portion which is abuttable against the driving member; a rotation connecting mechanism, connecting the lever and the gun body, including an axis with a position thereof being changeable, the lever being rotatable about the axis as a rotation center.

To achieve the above and other objects, the present invention further provides a method for using the caulking gun as described above, including following steps of: installing a caulk cartridge to the gun body; adjusting the position of the axis of the rotation connecting mechanism; pressing the lever.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
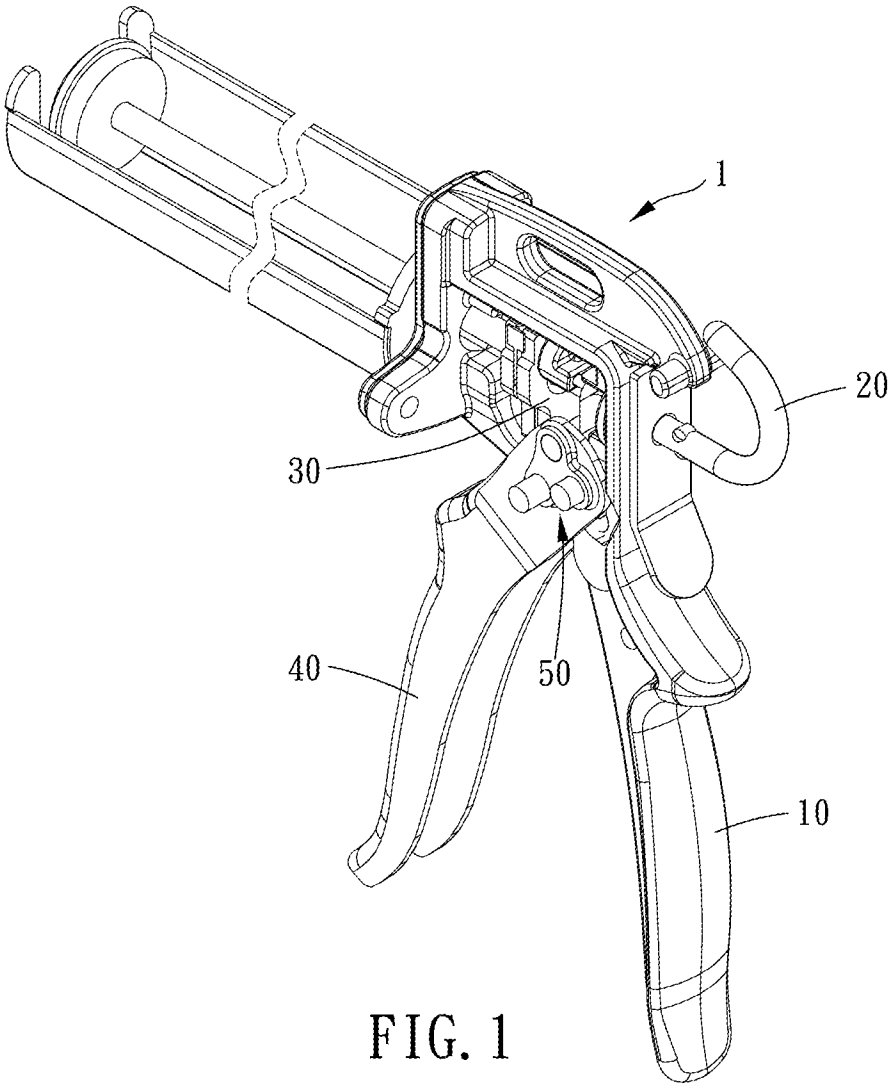
FIG. 1 is a stereogram of a preferable embodiment of the present invention.
Figure 2:
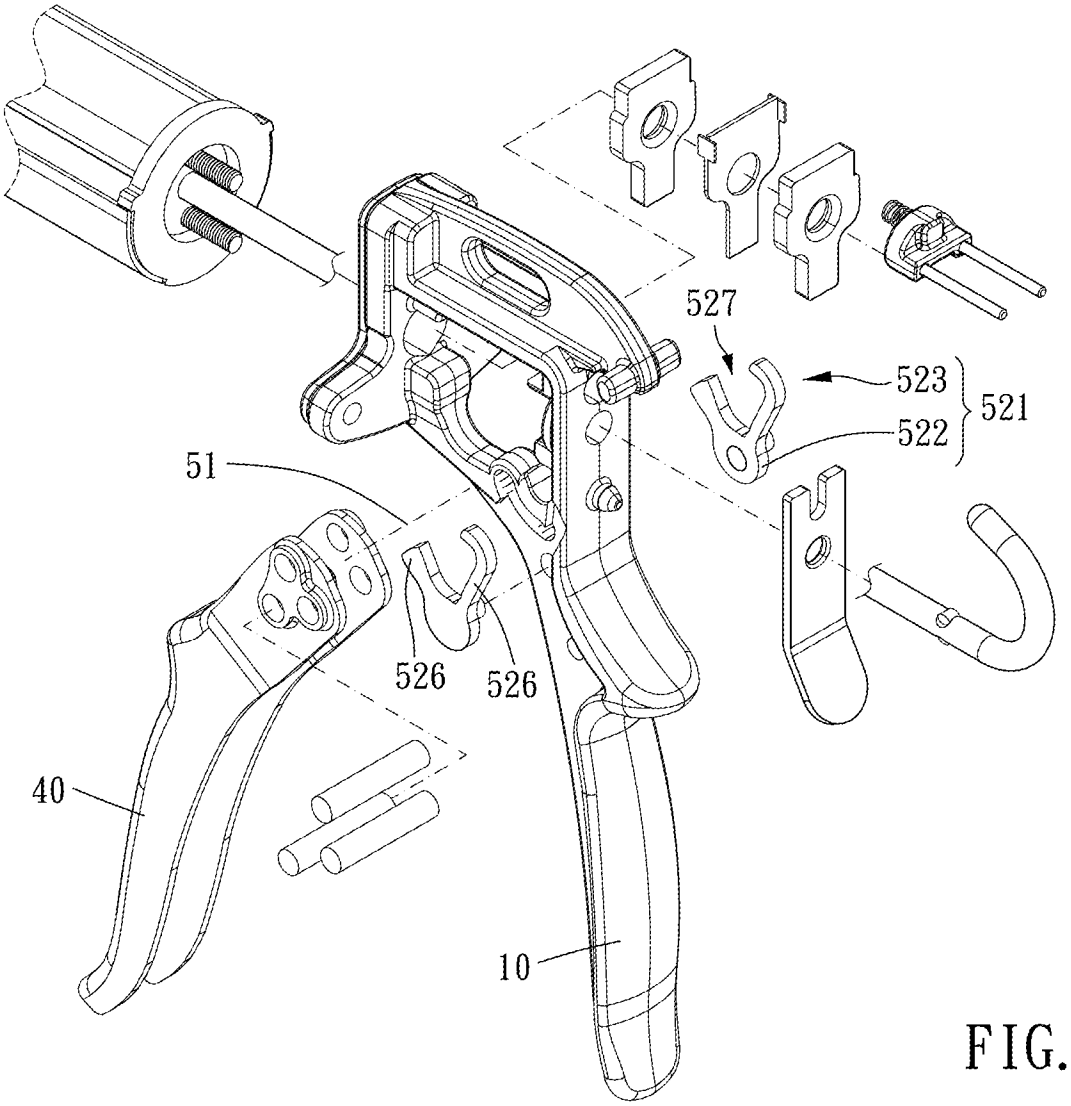
FIG. 2 is a breakdown drawing of a preferable embodiment of the present invention.
Figure 3:
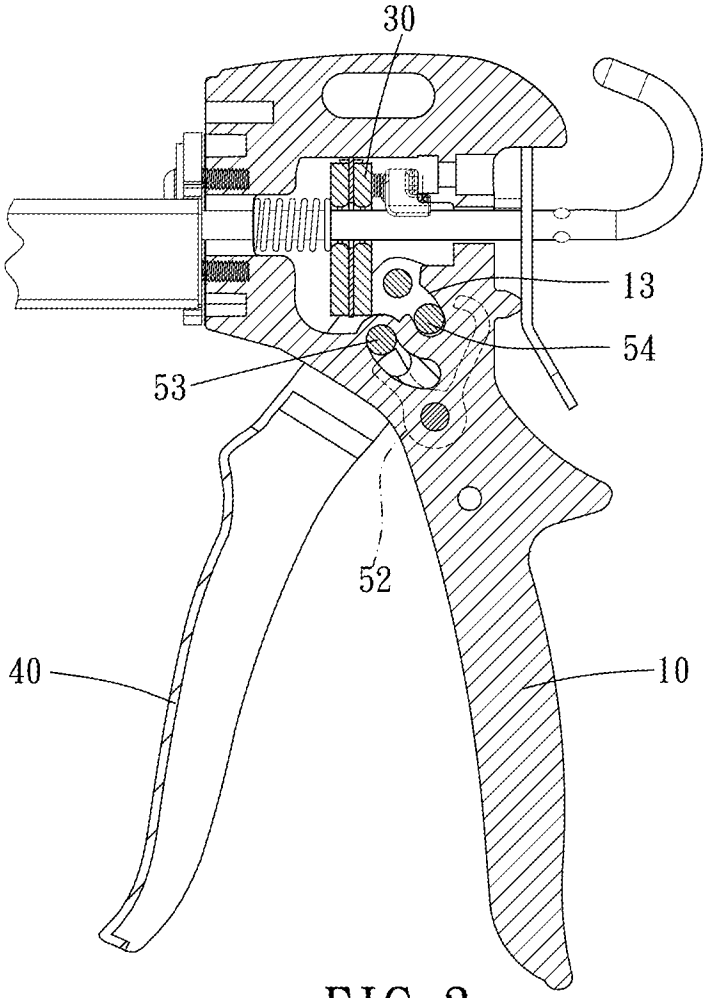
FIG. 3 is a partial cross-sectional view of a preferable embodiment of the present invention.
Figures 4, 5:
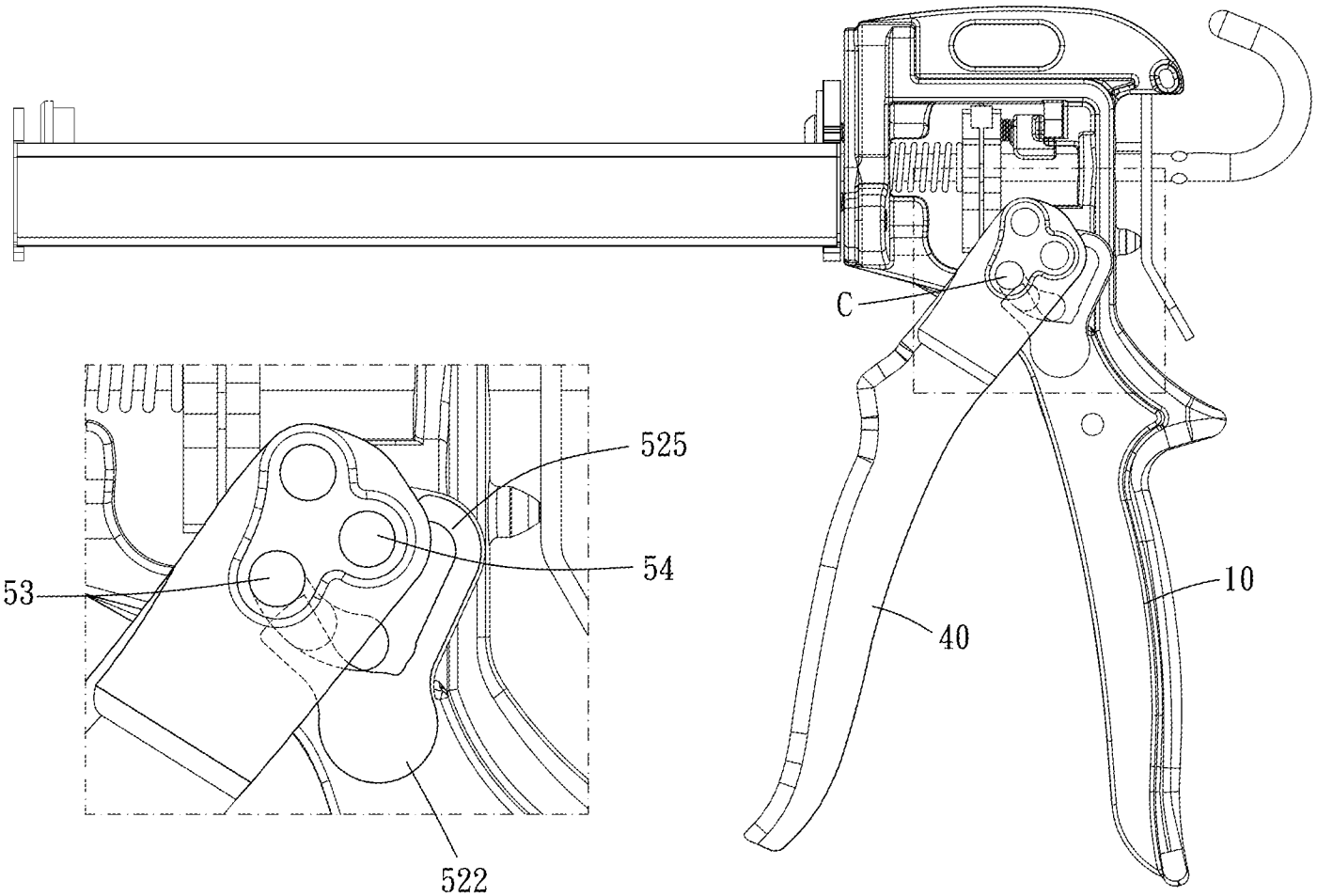
FIGS. 4 and 6 are schematic diagrams of a preferable embodiment of the present invention when a blocking portion is located at a first position.
FIG. 5 is a partial enlargement of FIG. 4.
Figures 6, 7:
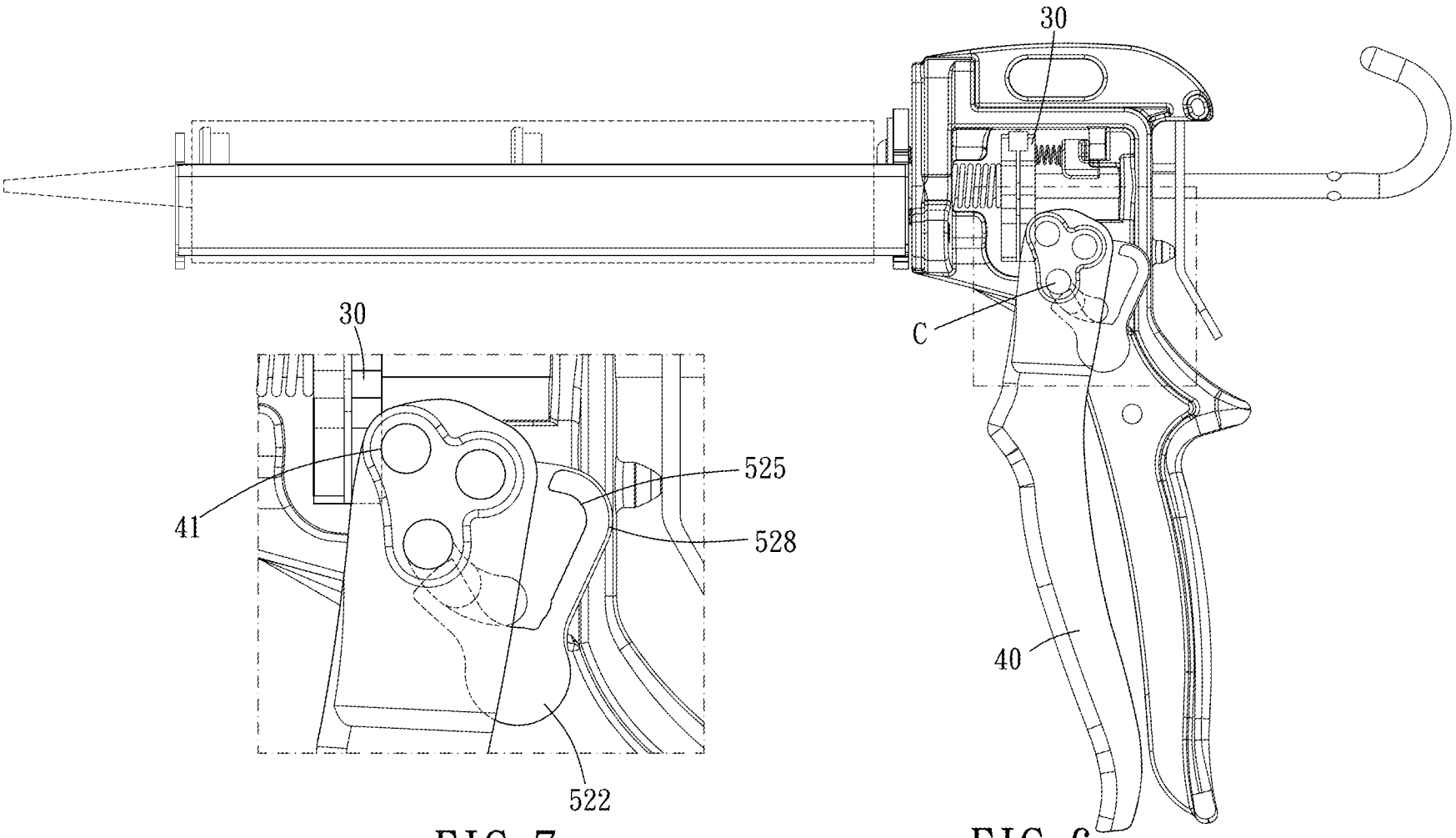
FIG. 7 is a partial enlargement of FIG. 6.
Figure 8:
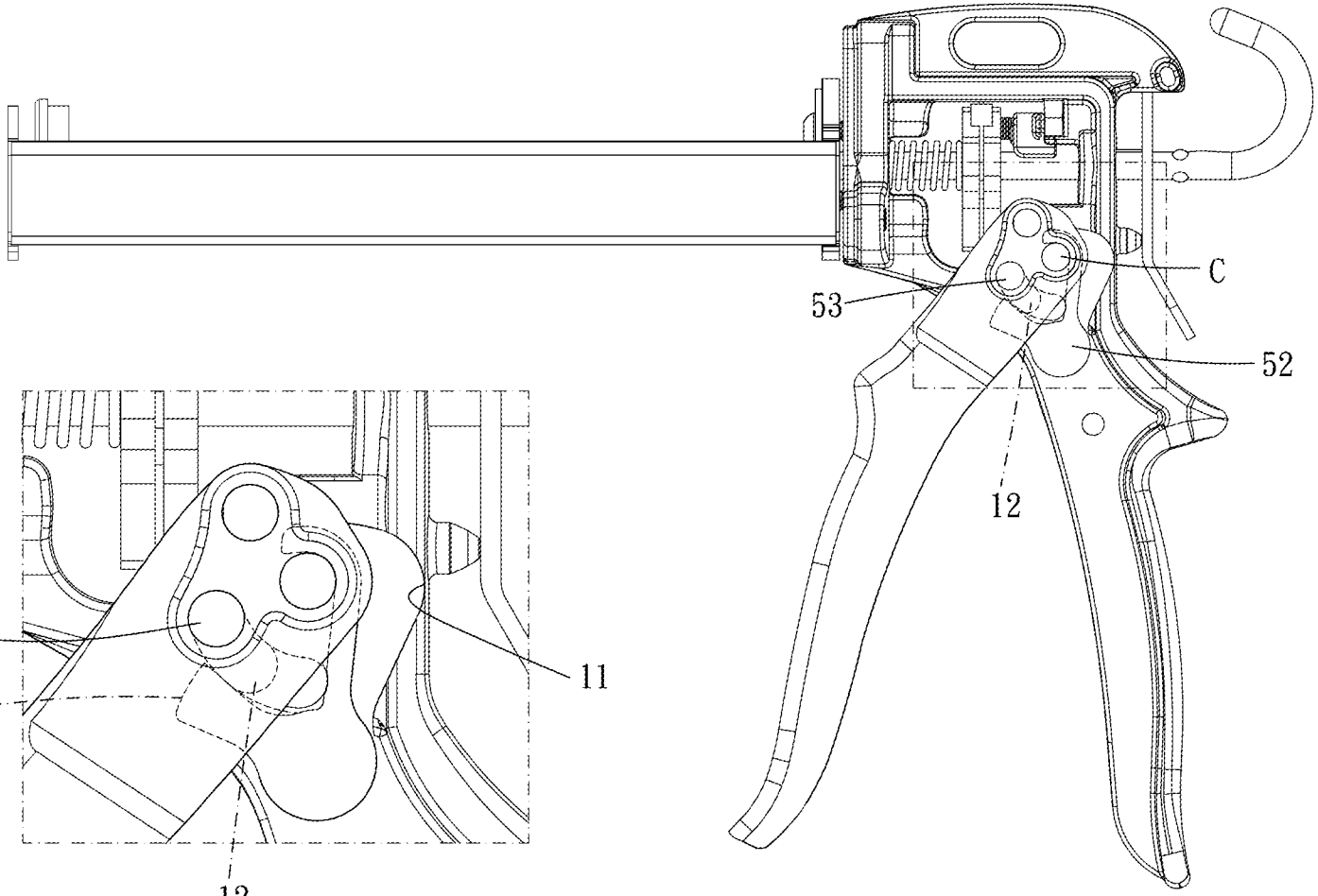
FIGS. 8 and 10 are schematic diagrams of a preferable embodiment of the present invention when a blocking portion is located at a second position.
Figure 9:
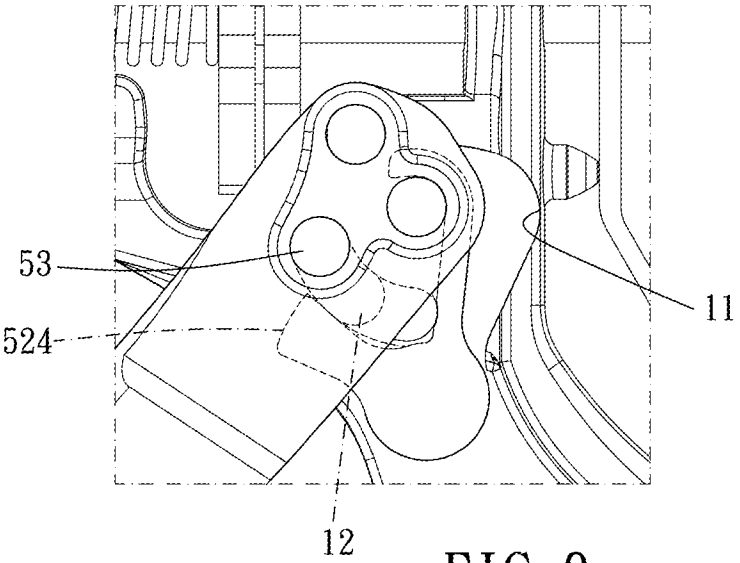
FIG. 9 is a partial enlargement of FIG. 8.
Figures 10, 11:
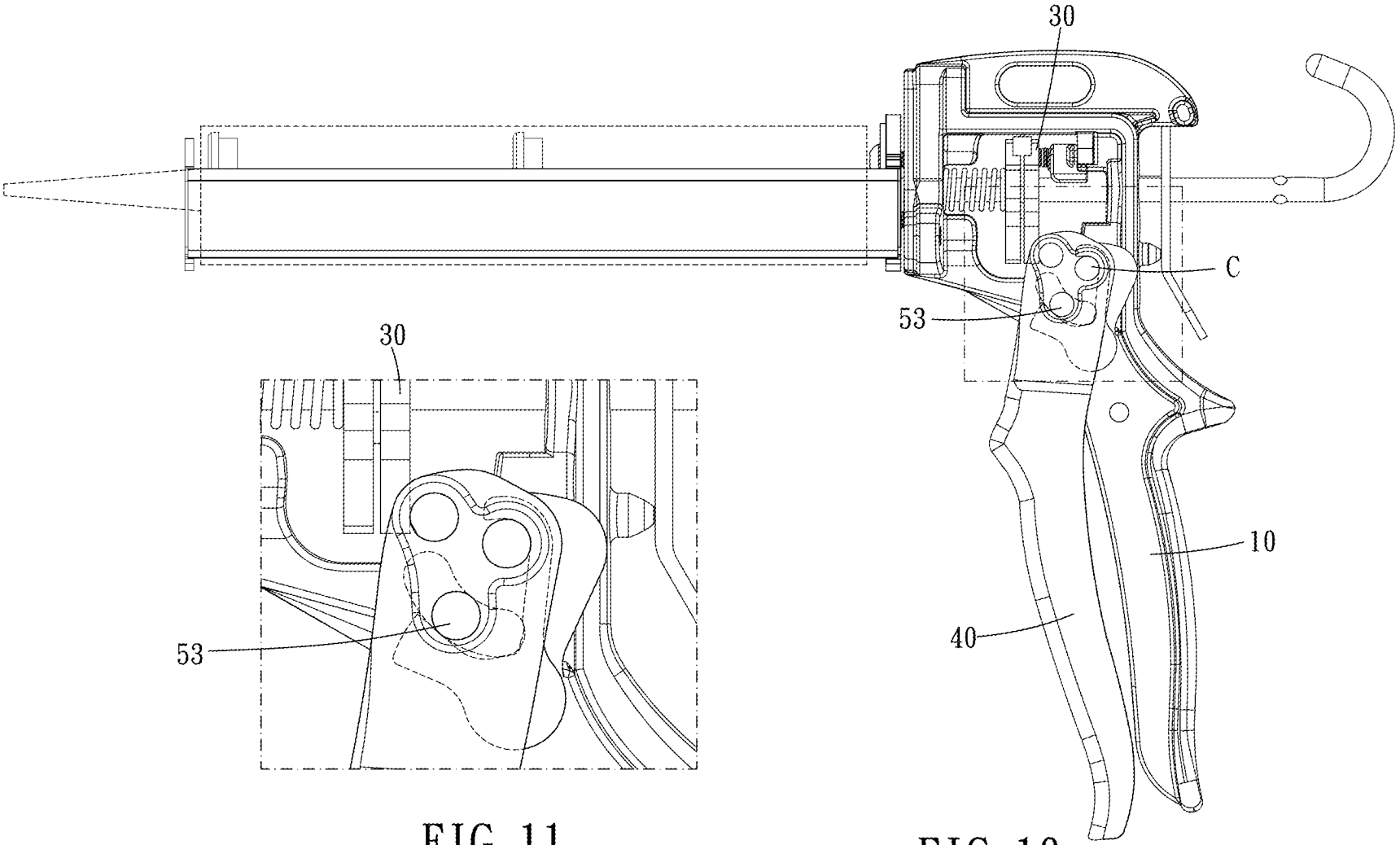
FIG. 11 is a partial enlargement of FIG. 10.

Please refer to FIGS. 1 to 11 for a preferable embodiment of the present invention. A caulking gun 1 of the present invention includes a gun body 10, a push rod 20, a driving member 30, a lever 40 and a rotation connecting mechanism 50.

The push rod 20 is movably disposed on the gun body 10. The driving member 30 is movably disposed within the gun body 10 and frictionally drives the push rod 20. The lever 40 is swingably disposed on the gun body 10 and includes an abutting portion 41 which is abuttable against the driving member 30. The rotation connecting mechanism 50 connects the lever 40 and the gun body 10, and the rotation connecting mechanism 50 includes an axis 51 with a position thereof being changeable. The lever 40 is rotatable about the axis 51 as a rotation center C. Therefore, a distance that the abutting portion 41 pushes the driving member 30 when the lever 40 is pressed is adjustable.

The rotation connecting mechanism 50 further includes a restricting member 52. The restricting member 52 is adjustably disposed on at least one of the gun body 10 and the lever 40 so that the position of the rotation center C is adjustable. The rotation connecting mechanism 50 further includes a first shaft 53 and a second shaft 54, and the first shaft 53 and the second shaft 54 are respectively disposed on at least one of the gun body 10 and the lever 40. One of the first shaft 53 and the second shaft 54 is restrictable by the restricting member 52 to serve as the rotation center C. In this embodiment, the first shaft 53 is disposed through the gun body 10 and the lever 40, and the second shaft 54 is disposed through the lever 40; the first shaft 53 and the second shaft 54 are preferably located at different positions in a longitude direction of the lever 40 so that the abutting portion 41 may have different swinging routes or traveling distance. In other embodiments, the rotation connecting mechanism may have only one shaft, and the shaft may be disposed through one of holes disposed on the gun body or the lever or be directly movable and restrictable to adjust the position of the rotation center.

Specifically, the restricting member 52 includes two blocking members 521 which are disposed at two opposite sides of the gun body 10. Each of the two blocking members 521 includes an assembling portion 522 configured to be assembled to the gun body 10 and a blocking portion 523 integrally extending from the assembling portion 522 which is located between the gun body 10 and the lever 40 and is movable to a first position and a second position relative to the gun body 10. In this embodiment, each said blocking portion 523 includes a blocking edge 524 adjacent to the first shaft 53 and a recession 525 configured to receive the second shaft 54. Each said blocking portion 523 includes two arm portions 526 which protrude from the assembling portion 522 in different directions, and each of the two arm portions 526 has one said blocking edge 524 and one said recession 525. A receiving groove 527 which is open toward the driving member 30 is defined between the two arm portions 526, and at least one of the first and second shafts 53, 54 is movable into or out of the receiving groove 527 so that the lever 40 is smoothly swingable.

In operation, when each said blocking portion 523 is located at the first position, the blocking edge 524 restricts the first shaft 53 and the first shaft 53 serves as the rotation center C, and the abutting portion 41 has a longer swinging route, as shown in FIGS. 4 to 7; when each said blocking portion 523 is located at the second position, the second shaft 54 is received within the recession 525 and the second shaft 54 serves as the rotation center C, and the abutting portion 41 has a shorter swinging route, as shown in FIGS. 8 to 11. Therefore, the swinging route of the abutting portion 41 is easily adjustable according to various requirements. Preferably, the two blocking members 521 are pivotally disposed on the gun body 10 and respectively have an arcuate convex portion 528 facing toward the gun body 10. The gun body 10 includes an arcuate concave portion 11 corresponding to the arcuate convex portion 528. When each said blocking portion 523 is located at the first position, at least part of the arcuate convex portion 528 is received within the arcuate concave portion 11, which prevents the restricting member 52 from over swinging so that the blocking edge 524 effectively corresponds to the first shaft 53.

The gun body 10 includes an arcuate groove 12, and the first shaft 53 is movably disposed within the arcuate groove 12. When the second shaft 54 serves as the rotation center C, the first shaft 53 is movable along the arcuate groove 12 so that the lever 40 can swing stably. The gun body 10 further includes a receiving portion 13 which is open toward the driving member 30 for receiving the second shaft 54. When the first shaft 53 serves as the rotation center C, the second shaft 54 is movable to be out of the receiving portion 13.

A method for using the caulking gun 1 as described above is further provided, including following steps of: installing a caulk cartridge to the gun body 10; adjusting the position of the axis 51 of the rotation connecting mechanism 50; pressing the lever 40. Therefore, the rotation center C of the lever 40 is easy to be adjusted, and the distance that the abutting portion 41 pushes the driving member 30 is adjustable, which provides precise control of a squeezing amount of the caulking material.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A caulking gun, including:

a gun body;

a push rod, being movably disposed on the gun body;

a driving member, being movably disposed within the gun body and frictionally driving the push rod;

a lever, being swingably disposed on the gun body, including an abutting portion which is abuttable against the driving member;

a rotation connecting mechanism, connecting the lever and the gun body, including an axis with a position thereof being changeable, the lever being rotatable about the axis as a rotation center;

wherein the rotation connecting mechanism further includes a restricting member, and the restricting member is adjustably disposed on at least one of the gain body and the lever so that the position of the rotation center is adjustable;

wherein the rotation connecting mechanism further includes a first shaft and a second shaft, the first shaft and the second shaft are respectively disposed on at least one of the gun body and the lever, and one of the first shaft and the second shaft is restrictable by the restricting member to serve as the rotation center.

2. The caulking gun of claim 1, wherein the restricting member includes two blocking members which are disposed at two opposite sides of the gun body, each of the two blocking members includes an assembling portion configured to be assembled to the gun body and a blocking portion integrally extending from the assembling portion which is located between the gun body and the lever and is movable to a first position and a second position relative to the gun body.

3. The caulking gun of claim 2, wherein the blocking portion of each of the two blocking members includes a blocking edge adjacent to the first shaft and a recession configured to receive the second shaft; when the blocking portion of each of the two blocking members is located at the first position, the blocking edge restricts the first shaft and the first shaft serves as the rotation center; when the blocking portion of each of the two blocking members is located at the second position, the second shaft is received within the recession and the second shaft serves as the rotation center.

4. The caulking gun of claim 3, wherein the blocking portion of each of the two blocking members includes two arm portions which protrude from the assembling portion in different directions, each of the two arm portions has one said blocking edge and one said recession, a receiving groove which is open toward the driving member is defined between the two arm portions, and at least one of the first and second shafts is movable into or out of the receiving groove.

5. The caulking gun of claim 4, wherein the two blocking members are pivotally disposed on the gun body and respectively have an arcuate convex portion facing toward the gun body, the gun body includes an arcuate concave portion corresponding to the arcuate convex portion, and when the blocking portion of each of the two blocking members is located at the first position, at least part of the arcuate convex portion is received within the arcuate concave portion; the gun body includes an arcuate groove, the first shaft is movably disposed within the arcuate groove; when the second shaft serves as the rotation center, the first shaft is movable along the arcuate groove; the gun body further includes a receiving portion which is open toward the driving member for receiving the second shaft, when the first shaft serves as the rotation center, the second shaft is movable to be out of the receiving portion; the first shaft and the second shaft are located at different positions in a longitude direction of the lever.

6. The caulking gun of claim 2, wherein the two blocking members are pivotally disposed on the gun body and respectively have an arcuate convex portion facing toward the gun body, the gun body includes an arcuate concave portion corresponding to the arcuate convex portion, and when the blocking portion of each of the two blocking members is located at the first position, at least part of the arcuate convex portion is received within the arcuate concave portion.

7. The caulking gun of claim 1, wherein the gun body includes an arcuate groove, the first shaft is movably disposed within the arcuate groove; when the second shaft serves as the rotation center, the first shaft is movable along the arcuate groove.

8. A method for using the caulking gun of claim 1, including following steps of:

installing a caulk cartridge to the gun body;

adjusting the position of the axis of the rotation connecting mechanism;

pressing the lever.

* * * * *